US011314195B2

(12) United States Patent
Oh et al.

(10) Patent No.: US 11,314,195 B2
(45) Date of Patent: Apr. 26, 2022

(54) WASTE TONER COLLECTING DEVICE FOR INCREASING WASTE TONER COLLECTING EFFICIENCY

(71) Applicant: HEWLETT-PACKARD DEVELOPMENT COMPANY, L.P., Spring, TX (US)

(72) Inventors: Hyun Taek Oh, Suwon-si (KR); Dongwoo Lee, Suwon-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/057,090

(22) PCT Filed: Sep. 10, 2019

(86) PCT No.: PCT/US2019/050382
§ 371 (c)(1),
(2) Date: Nov. 19, 2020

(87) PCT Pub. No.: WO2020/055844
PCT Pub. Date: Mar. 19, 2020

(65) Prior Publication Data

US 2021/0200138 A1 Jul. 1, 2021

(30) Foreign Application Priority Data

Sep. 10, 2018 (KR) ..... 10-2018-0107837

(51) Int. Cl.
*G03G 21/10* (2006.01)
*G03G 21/12* (2006.01)
(Continued)

(52) U.S. Cl.
CPC ..... *G03G 21/105* (2013.01); *G03G 15/0893* (2013.01); *G03G 21/10* (2013.01);
(Continued)

(58) Field of Classification Search
CPC .. G03G 21/105; G03G 15/0893; G03G 21/12; G03G 21/10; G03G 2221/1624; G03G 15/553
See application file for complete search history.

(56) References Cited

U.S. PATENT DOCUMENTS

2009/0136259 A1* 5/2009 Ito ..... G03G 21/105 399/120
2010/0080600 A1 4/2010 Okamoto et al.
(Continued)

FOREIGN PATENT DOCUMENTS

CN 101231505 B 12/2010
JP 2003066802 A 3/2003
(Continued)

*Primary Examiner* — Walter L Lindsay, Jr.
*Assistant Examiner* — Laura Roth
(74) *Attorney, Agent, or Firm* — Conley Rose, P.C.

(57) ABSTRACT

A waste toner collecting device includes a waste toner container, a detector, and an auger. The waster toner container is to collect waste toner. The detector is to detect an amount of waste toner collected and accumulated in the waste toner container. The auger is to disperse the waste toner in the waste toner container. The auger includes a first blade to transport the waste toner in a first direction toward the detector in the waste toner container, and a second blade to transport the waste toner in a second direction opposite to the first direction in the waste toner container. The second blade includes a first blade section having a waste toner transport rate greater than a waste toner transport rate of the first blade.

15 Claims, 12 Drawing Sheets

(51) Int. Cl.
*G03G 15/08* (2006.01)
*G03G 15/00* (2006.01)

(52) U.S. Cl.
CPC ..... *G03G 21/12* (2013.01); *G03G 15/553* (2013.01); *G03G 2221/1624* (2013.01)

(56) References Cited

U.S. PATENT DOCUMENTS

| | | | | |
|---|---|---|---|---|
| 2011/0097124 | A1 | 4/2011 | Koike et al. | |
| 2014/0010579 | A1* | 1/2014 | Yoshino | G03G 21/105 399/358 |
| 2014/0044465 | A1* | 2/2014 | Mekada | G03G 21/12 399/358 |
| 2015/0003881 | A1* | 1/2015 | Shima | G03G 21/105 399/360 |
| 2016/0202657 | A1* | 7/2016 | Koseki | G03G 21/10 399/35 |

FOREIGN PATENT DOCUMENTS

| | | | | |
|---|---|---|---|---|
| JP | 2011112676 | A | | 6/2011 |
| JP | 2012042789 | A | | 3/2012 |
| JP | 2013068806 | A | * | 4/2013 |
| JP | 2014013294 | A | | 1/2014 |
| JP | 2015215511 | A | | 12/2015 |

* cited by examiner

WASTE TONER COLLECTING DEVICE FOR INCREASING WASTE TONER COLLECTING EFFICIENCY

BACKGROUND

An image forming apparatus is an apparatus for developing a black-and-white image or a color image onto paper according to an image signal. Representative examples of the apparatus include a laser printer, an inkjet printer, a copy machine, a multifunction printer, a facsimile, etc.

An electrophotographic image forming apparatus attaches a toner to a photoconductor on which an electrostatic latent image is formed or an intermediate transfer device, converts the electrostatic latent image into a visible toner image, and then transfers the toner image onto paper to thereby output a predetermined image.

A non-transfer toner (hereinafter referred to as "waste toner") remains in a photosensitive medium when a toner image is transferred from the photoconductor or the intermediate transfer device onto paper. Such waste toner may need to be removed to properly output a next image. Accordingly, the electrophotographic image forming apparatus is provided with a waste toner collecting device for collecting waste toner that has not yet been transferred, but remains.

DETAILED DESCRIPTION

The present disclosure is not limited to an example disclosed below and may be implemented in various forms and the scope of the present disclosure is not limited to the following examples. In addition, all changes or modifications derived from the meaning and scope of the claims and their equivalents should be construed as being included within the scope of the present disclosure. In the following description, the configuration which is publicly known but irrelevant to the gist of the present disclosure could be omitted. In addition, the attached drawings are not drawn to scale to facilitate understanding of the present disclosure, but the dimensions of some of the components may be exaggerated.

Hereinafter, referring to FIG. 1, an image forming apparatus 1 according to an example of the present disclosure will be briefly described, and then a waste toner collecting device 100 will be described in detail.

Figure 1:
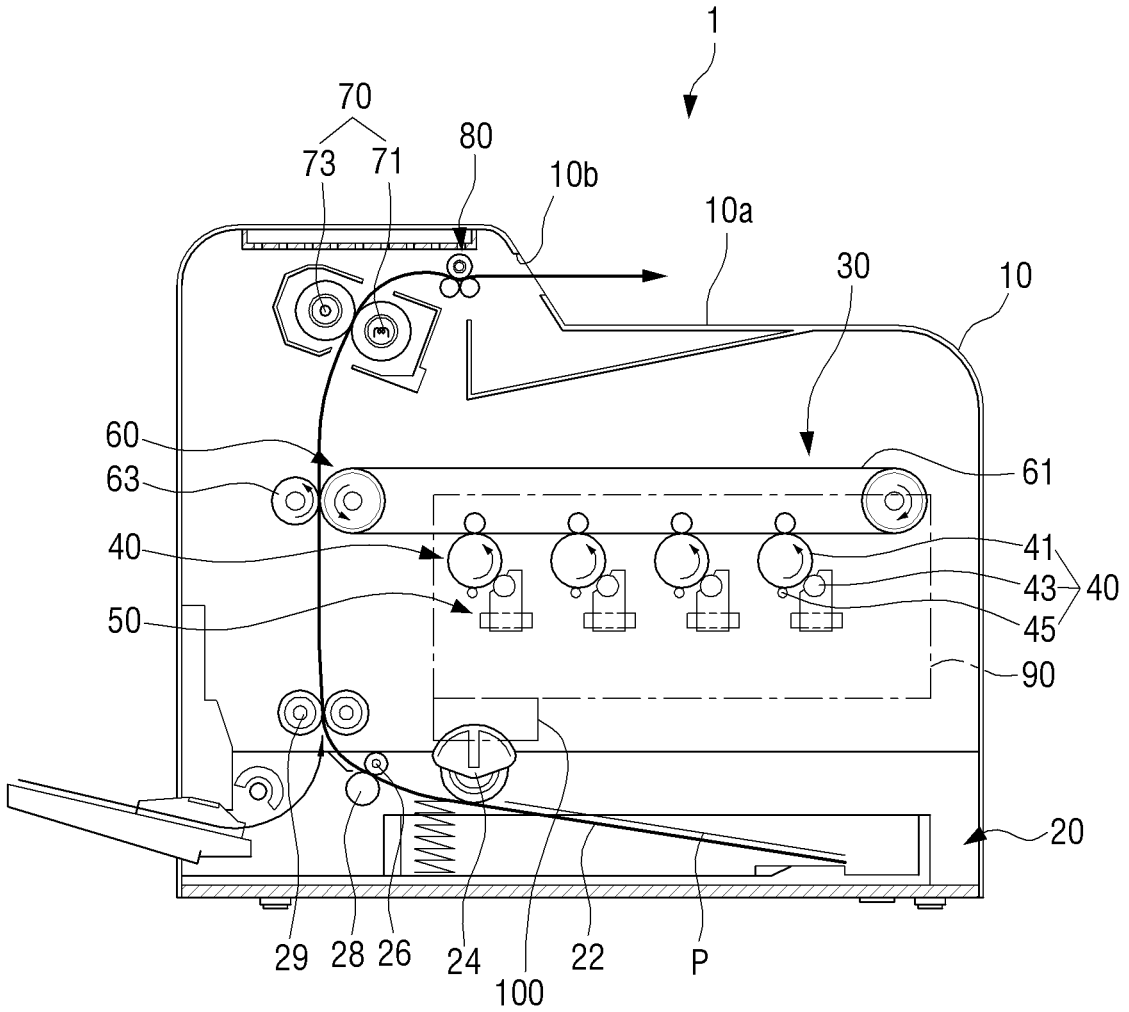
FIG. 1 is a schematic cross-sectional view illustrating an image forming apparatus according to an example of the present disclosure.

FIG. 1 is a schematic cross-sectional view illustrating an image forming apparatus according to an example of the present disclosure.

An image forming apparatus 1 may include a body 10, a paper-feeding device 20, a printing engine 30, and a discharging device 80.

The body 10 may be provided with a discharging tray 10*a* where paper with image formation completed is loaded on its upper part, and a paper-discharge hole 10*b* from which the paper with image formation completed is discharged and is disposed on one side of the discharging tray 10*a*.

The paper-feeding device 20 may be detachably and movably mounted on the body 10, including a knock-up plate 22 disposed in the paper-feeding device 20 to load paper.

The paper-feeding device 20 may include a pick-up roller 24 which is disposed at an upper part of one side of the paper-feeding device 20 and picks up paper loaded in the knock-up plate 22 one-piece by one-piece, a forward roller 26 which receives the paper picked up by the pick-up roller 24 and moves the paper toward a transport roller 29, a retard roller 28 which is disposed opposite to the forward roller 26 and prevents a plurality of pieces of paper from moving simultaneously, and a pair of transport rollers 29 which is disposed above the pick-up roller 24 and guides the paper picked up by the pick-up roller 24 to the printing engine 30.

The printing engine 30 may form an image on paper P supplied from the paper-feeding device 20. The printing engine 30 may form an image on the paper P by using an electro-photo method.

The printing engine 30 may include a developing device 40, a developing cartridge 50, a transfer device 60, and a fusing device 70.

The developing device 40 may form a predetermined image on the supplied paper P, and the fusing device 70 may fix a visible image onto the paper. The developing device 40 may include a photoconductor 41 which includes an image carrier for receiving a visible image by a toner, in which an electrostatic latent image is formed on its surface by an exposing device, a developing roller 43 which supplies a toner to the photoconductor 41 and allows the electrostatic latent image of the photoconductor 41 to be developed into a visible image by the toner, and a charging roller 45 which charges a surface of the photoconductor 41.

The developing device 40 and the developing cartridge 50 may include a plurality of developing devices and a plurality of developing cartridges, respectively. The plurality of developing cartridges 50 may be connected to the plurality of developing devices 40, respectively, and developers accommodated in the plurality of developing cartridges 50 may be respectively supplied to the plurality of developing devices 40. The plurality of developing cartridges 50 and the plurality of developing devices 40 may be replaced individually.

The plurality of photoconductors 41 may form an electrostatic latent image, the developing cartridge 50 may attach a toner to each photoconductor 41 to form a visible image, and the transfer device 60 may transfer a visible image to paper.

The plurality of developing cartridges 50 may include a plurality of developer accommodation parts which respectively accommodate developers of C: cyan, M: magenta, Y: yellow and K: black. However, the present disclosure is not limited thereto, but may further include the developing cartridges 50 and the developing devices 40 for accommodating and developing developers of various colors such as light magenta, white, etc.

Each of the plurality of developing cartridges 50 may store a toner of different color (e.g., yellow, magenta, cyan, and black), and attach a toner to the photoconductor 41 on which an electrostatic latent image is formed to form a visible image of different color.

The transfer device 60 may include an intermediate transfer belt 61 for overlapping a visible image formed in each photoconductor 41 and forming a color visible image, and a last transfer roller 63 for transferring the color visible image formed in the intermediate transfer belt 61 to paper. The visible image formed in each photoconductor 41 may be sequentially transferred and overlapped in the intermediate transfer belt 61, and the visible image formed in each photoconductor 41 may be transferred to the immediate transfer belt 61.

The visible image transferred to the paper P may be fused to a paper surface by receiving heat and pressure while passing through the fusing device 70. The fusing device 70 may include a heating roller 71 which generates heat, and a pressure roller 73 which has an elastically deformable outer circumferential surface and presses paper against the outer circumferential surface of the heating roller 71.

The paper P passing through the fusing device 70 may be discharged to the outside of the image forming apparatus 10 by the discharging device 80.

A waste toner may be inevitably generated in the developing device 40 when an image is developed on the paper P by a toner. Accordingly, although not shown, the developing device 40 may further include a cleaning device to remove the waste toner that remains in the photoconductor 41 after a transfer process.

The cleaning device may be disposed adjacent to the photoconductor 41 and remove a waste toner that has not yet been transferred, but remains in the photoconductor 41.

A waste toner transport device 90 and a waste toner collecting device 100 may be mounted on one side of the body 10 to store the removed waste toner. The waste toner transport device 90 may guide waste toner separated from the photoconductor 41 to the waste toner collecting device 100, and the waste toner collecting device 100 may store the waste toner collected from the waste toner transport device 90.

The waste toner transport device 90 and the waste toner collecting device 100 may be detachably mounted on one side of the body 10.

The waste toner may be generated in the intermediate transfer belt 61. The toner which is transferred to the paper P and remains in the intermediate transfer belt 61 may be removed by a cleaning device (not shown) and accommodated in the waste toner transport device 90. The waste toner may be also discharged to the waste toner collecting device 100.

As described above, the configuration of the image forming apparatus according to an example has been described in detail. However, a developing method is not limited thereto, but various modifications and changes can be employed in the configuration of the image forming apparatus using the developing method.

Figure 2:
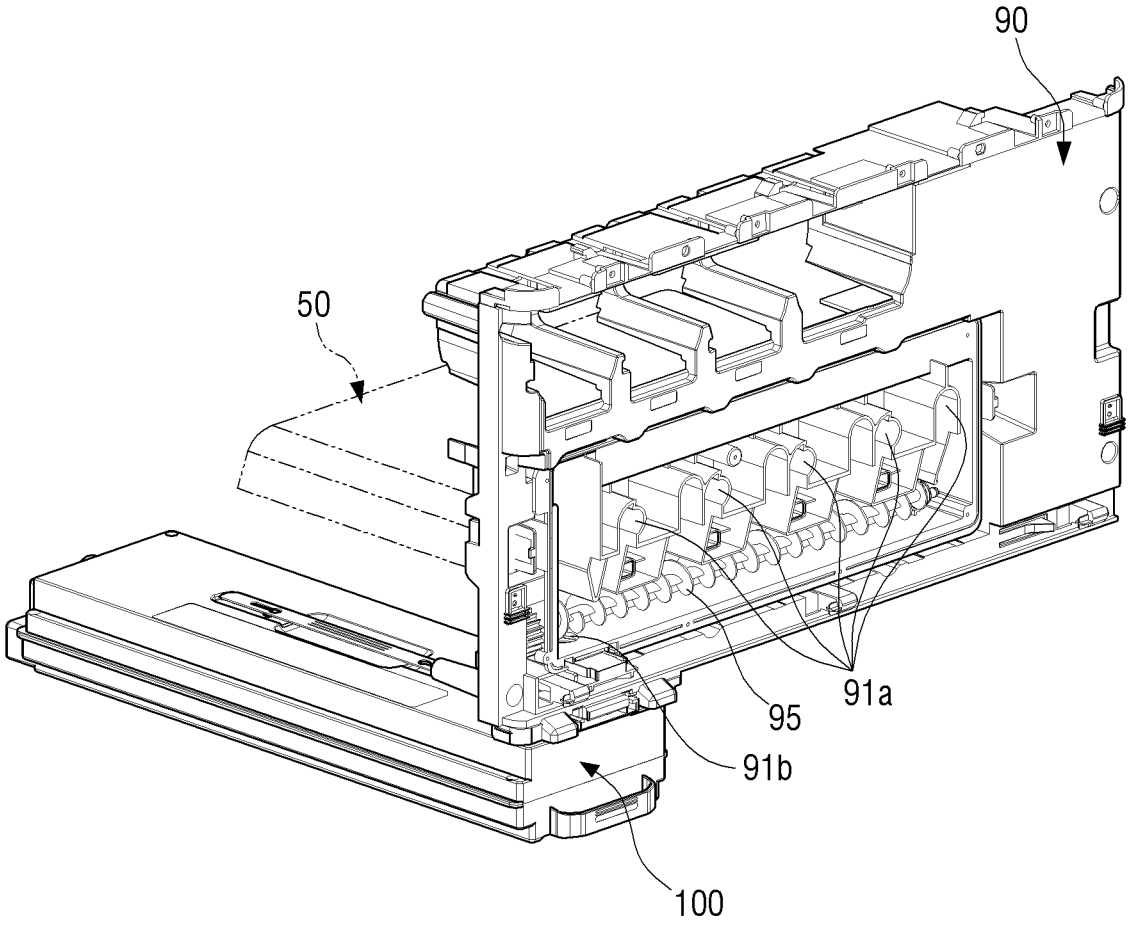
FIG. 2 is a schematic perspective view illustrating a waste toner transport device and a waste toner collecting device in an image forming apparatus according to an example of the present disclosure.

FIG. 2 is a schematic perspective view illustrating a waste toner transport device and a waste toner collecting device in an image forming apparatus according to an example of the present disclosure.

Referring to FIG. 2, a waste toner transport device 90 may be disposed to face the photoconductor 41. Accordingly, the waste toner removed from the surface of the photoconductor 41 by the cleaning device (not shown) may flow into the waste toner transport device 90.

The waste toner transport device 90 may include an inlet 91*a* for receiving waste toner which drops from the photoconductor 41, and an outlet 91*b* which is disposed on one side under the inlet and allows the waste toner to be transported to the waste toner collecting device 100 under the outlet.

In addition, the waste toner removed from the surface of the immediate transfer belt 61 may flow into the waste toner transport device 90.

The waste toner collecting device 100 may be disposed on one side under the waste toner transport device 90. The waste toner discharged from the outlet 91*b* of the waste toner transport device 90 may be collected in the waste toner collecting device 100.

A waste toner transport auger 95 which transports waste toner from the inlet 91*a* to the outlet 91*b* may be disposed in the waste toner transfer device 90.

The waste toner transport auger 95 may be rotatably mounted in the waste toner transport device 90. The waste toner transport auger 95 may transport waste toner flowing into the waste toner transport device 90 from the photoconductor 41 to the waste toner collecting device 100. The waste toner collecting device 100 may be mounted on one end under the waste toner transport device 90 to be connected to the waste toner transport device 90. A waste toner inlet 111 (referring to FIG. 3) of the waste toner collecting device 100 may face the outlet 91*b* of the waste toner transport device 90.

Waste toner may be transported to one side (toward outlet 90*b*) by rotation of the waste toner transport auger 95, and the transported waste toner may be transported to the waste toner collecting device 100.

Figure 3:
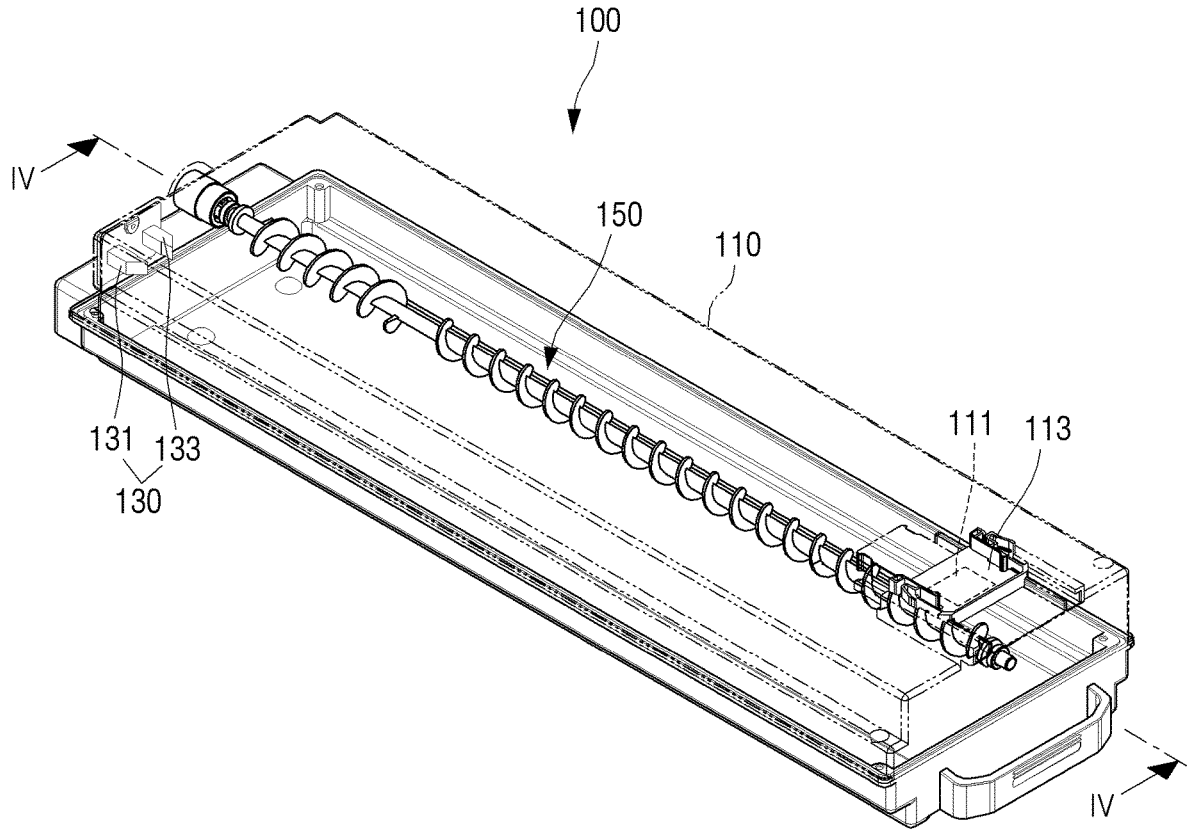
FIG. 3 is a perspective view illustrating an inside of a waste toner collecting device according to an example of the present disclosure.

FIG. 3 is a perspective view illustrating an inside of a waste toner collecting device according to an example of the present disclosure.

Referring to FIG. 3, a waste toner collecting device 100 may include a waste toner container 110, a detector 130, and an auger 150.

A waste toner inlet 111 into which the waste toner transported by the waste toner transport device 90 flows may be formed on one side of an upper surface of the waste toner container 110. Waste toner flowing through the waste toner inlet 111 may be stored in the waste toner container 110.

The waste toner inlet 111 may be provided with a shutter 113 which selectively opens and closes the waste toner inlet 111. The shutter 113 may open the waste toner inlet 111 when the waste toner collecting device 100 is combined with the waste toner transport device 90, and close the waste toner inlet 111 when the waste toner collecting device 100 is detached from the image forming apparatus 1.

The waste toner container 110 may be a consumable product which is replaced when a space for storing waste toner is full. The detector 130 may detect waste toner accumulated in the waste toner container 110 and determine whether the waste toner container 110 is full.

According to an example of the present disclosure, by improving the storage efficiency of a storage space of the waste toner container 110, a replacement cycle of the waste toner container 110 may become longer, and thus the cost of consumables may be reduced.

The detector 130 may be provided in the waste toner container 110 to detect whether the waste toner container 110 is full.

The detector 130 may be disposed on the other side, which is opposite to the waste toner inlet 111. The detector 130 may be disposed farthest from where waste toner flows and accommodate the large amount of waste toner in the waste toner container 110.

The detector 130 may be disposed at a predetermined height of the waste toner container 110. The detector 130 may be disposed above lowest points of blades 153 and 155 of the auger 150 in the waste toner container 110.

The detector 130 according to an example of the present disclosure may be a light sensor including a light emitting part 131 and a light receiving part 133. Light emitted from the light emitting part 131 may be incident on the light receiving part 133. When waste toner accumulates above a predetermined height, light may be partly blocked by the waste toner, and the amount of light incident on the light receiving part 133 may be reduced. When the amount of light detected by the light receiving part 133 is smaller than or equal to a predetermined reference amount of light, it is determined that the waste toner container 110 is full. In this case, a user may be notified to replace the waste toner container 110.

However, the waste toner capacity of the waste toner container 110 at a time when waste toner is detected by the detector 130 may not mean that the waste toner container 110 is full, after a predetermined time passes from a time when the detector 130 detects waste toner, a user may be notified that the waste toner container 110 is full, and thus efficiency may be increased.

The auger 150 for dispersing the waste toner accumulated in the waste toner container 110 may be mounted in the waste toner container 110. The auger 150 may be disposed in a horizontal direction with respect to the waste toner container 110 to disperse the waste toner in a horizontal direction of the waste toner container 110.

The auger 150 may be rotatably mounted in the waste toner container 110 to cause the waste toner collected in the waste toner container 110 to be flattened. The detailed structure of the auger 150 to disperse the waste toner accumulated in the waste toner container 110 will be described below.

Figure 4A:
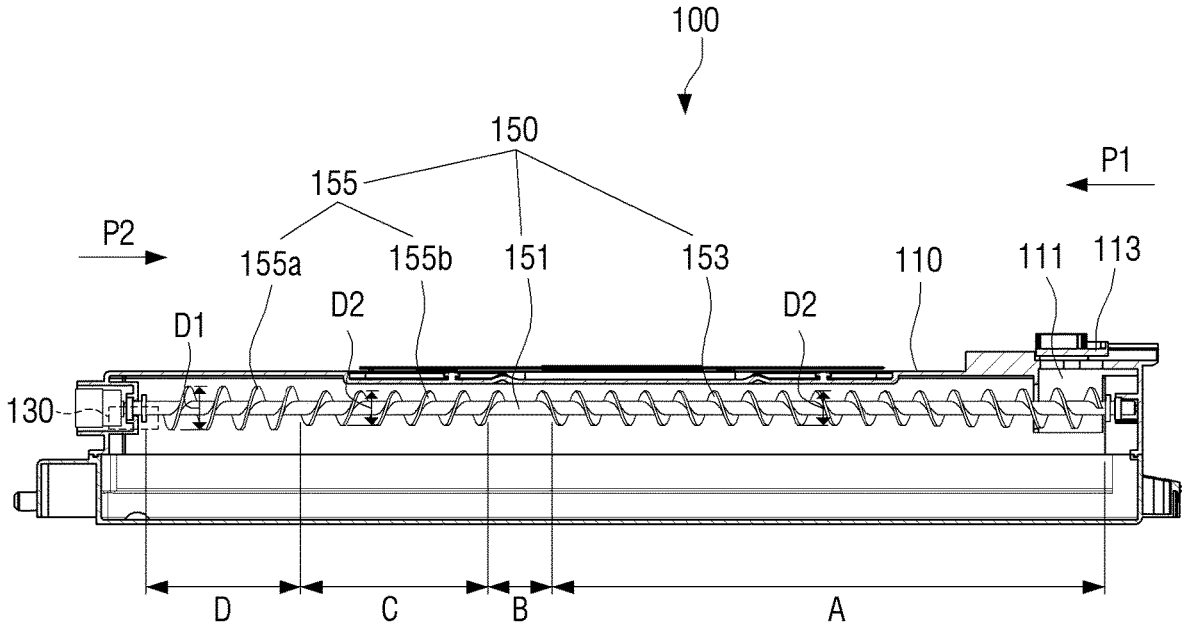
FIG. 4A is a cross-sectional view taken along line IV-IV shown in FIG. 3.

FIG. 4A is a cross-sectional view taken along line IV-IV shown in FIG. 3.

Referring to FIG. 4A, the waste toner container 110 may be provided with the auger 150 which disperses the stored waste toner. The waste toner flowing into the waste toner container 110 through the waste toner inlet 111 may drop by its own weight and accumulate under the waste toner inlet 111.

As such, the waste toner flowing into the waste toner container 110 may accumulate in a mountain-like shape. Waste toner has lower fluidity and higher cohesion than new toner since impurities such as fiber constituents of paper are included during a printing process.

Although the waste toner container is not full, when the upper part of the waste toner, which accumulates in a mountain-like shape, is detected by the detector 130, although the waste toner container 110 has a capacity to accommodate waste toner, the waste toner container 110 may need to be replaced. Therefore, it may be disadvantageous to use the waste toner collecting device 100 longer, and waste toner collecting efficiency may be reduced.

The waste toner collecting device 100 according to an example of the present disclosure may include an auger 150 which disperses waste toner in the waste toner container 110.

The auger 150 may include a rotational shaft 151 and spiral-shaped blades 153 and 155. One end of the rotational shaft 151 may extend to the outside of the waste toner container 110. A gear (not shown) may be provided at one end of the rotational shaft 151 as an example of a power driving mechanism. When the waste toner collecting device 100 is mounted on the image forming apparatus 1, the gear may be connected to a driver of the image forming apparatus, and thus the auger 150 may be driven.

The auger 150 according to an example of the present disclosure may delay a time at which the detector 130 detects whether the waste toner container is full.

The auger 150 may include the rotational shaft 151, the first blade 153 and the second blade 155 spirally protruding from the rotational shaft 151. The first and second blades 153 and 155 may be spiral-shaped blades disposed in a line to be spaced apart from each other by a predetermined distance on the rotational shaft 151.

The first blade 153 may transport waste toner flowing from the waste toner inlet 111 toward a first direction P1. The first direction P1 may be a direction from the waste toner inlet 111 toward the detector 130. The second blade 155 may transport the waste toner flowing from the waste toner inlet 111 toward a second direction P2. The second direction P2 may be a direction from the detector 130 toward the waste toner inlet 111, which is opposite to the first direction P1.

The first blade 153 and the second blade 155 may be disposed on the same rotational shaft 151. While the rotational shaft 151 rotates, waste toner may be transported in the first direction P1 by the first blade 153, and in the second direction P2 by the second blade 155.

The first blade 153 may be disposed adjacent to the waste toner inlet 111, and the second blade 155 may be disposed adjacent to the detector 130. The first blade 153 may be disposed closer to the second direction P2 than the second blade 155 and transport waste toner flowing from the waste toner inlet 111 in a length direction of the waste toner container 110.

The second blade 155 may include a first blade section 155*a* having a waste toner transport rate greater than a waste toner transport rate of the first blade 153.

The second blade 155 may include a first blade section 155*a* and a second blade section 155*b*. The first blade section 155*a* may be disposed closest to the detector 130 among all blade sections of the second blade 155.

The first blade section 155*a* may be disposed in the first direction P1 than the second blade section 155*b* to delay a transport speed of the waste toner transported in the first direction P1.

The transport speed of the waste toner transported to the detector 130 may be reduced by the first blade section 155*a*. Accordingly, it is possible to delay a time at which the detector 130 detects whether the waste toner container is full.

A diameter D1 of the first blade section 155*a* may be greater than a diameter of the first blade 153 and a diameter D2 of the second blade section 155*b*. When the diameter D1 of the first blade section 155*a* is greater, the amount of waste toner transported in the second direction P2 by rotation of the rotational shaft 151 may be greater than the amount of waste toner transported in other blade sections. Accordingly, a transport speed of the waste toner transported to the detector 130 may be slowed.

A transport speed of the waste toner transported to the detector 130 by the first blade section 155*a* may be controlled.

For example, when the diameter D1 of the first blade section 155*a* is greater than the diameter of the first blade 153 and the diameter D2 the second blade section 155*b*, the amount of waste toner which remains near the first blade section 155*a* may be increasingly transported in the second direction P2, and the speed of the waste toner transported toward the detector 130 may be reduced. Accordingly, it can be prevented that the waste toner collecting device 100 is replaced before the waste toner container 110 is full, and thus the waste toner collecting device 100 may be used longer.

FIG. 4A illustrates that the diameter D1 of the first blade section 155*a* is greater than the diameter of the first blade 153 and the diameter D2 of the second blade section 155*b*. However, the present disclosure is not limited thereto, and a waste toner transport rate of the first blade section 155*a* may be greater than waste toner transport rates of other blade sections.

Figure 4B:
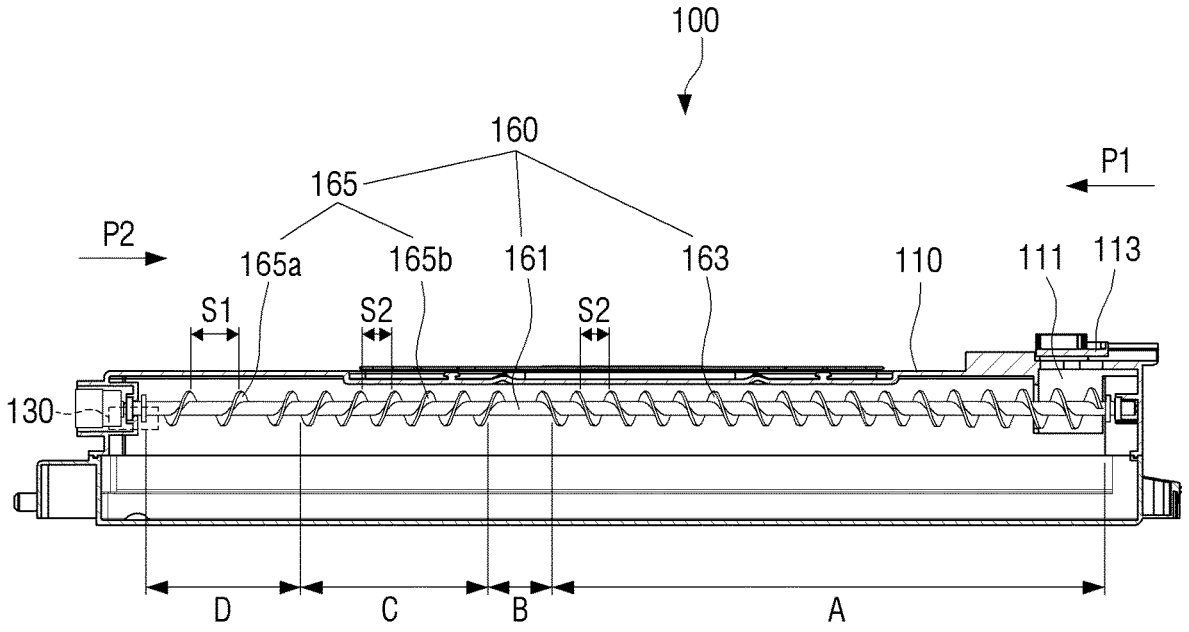
FIG. 4B is a cross-sectional view illustrating a waste toner collecting device to which an auger is applied according to another example of the present disclosure.

FIG. 4B is a cross-sectional view illustrating a waste toner collecting device to which an auger is applied according to another example of the present disclosure.

Referring to FIG. 4B, an auger 160 according to another example of the present disclosure may include a rotational shaft 161 and blades 163 and 165 for spirally winding the rotational shaft 161.

Referring to FIG. 4B, the blades 163 and 165 may include a first blade 163 and a second blade 165. The first blade 163 is the same configuration as that of an example described in FIG. 4A, and thus the first blade section 165*a* of the second blade 165 will be described in detail to explain difference.

For example, a pitch S1 of the first blade section 165*a* may be greater than a pitch S2 of the first blade 163 and the second blade section 165*b* of the second blade. The pitch may refer to an arrangement spacing of blades in an axial direction of the rotational shaft 161. When the pitch S1 of the first blade section 165*a* is greater, the amount of waste toner transported from the first blade section 165*a* toward the second direction P2 by the rotation of the rotational shaft 161 may be greater than the amount of waste toner transported from other blade sections. Accordingly, the transport speed of the waste toner transported to the detector 130 may be reduced.

Referring to FIGS. 4A and 4B, at least one of the diameter D1 or the pitch S1 of the first blade sections 155*a* and 165*a* may be greater than at least one of the diameter D1 or the pitch S1 of the first blade 153 and second blade sections 155*b* and 165*b*.

The second blades 155 and 165 with the first blade sections 155*a* and 165*a* may be disposed closer to the first direction P1 than the first blades 153 and 163, and reversely transport waste toner transported toward detector 130 to thereby slow down the speed at which the waste toner is detected by the detector 130.

The first blades 153 and 163 may be disposed to be spaced apart from the second blades 155 and 165. The augers 150 and 160 may have four sections. The first section A may include the first blades 153 and 163 formed in the first direction P1, the second section B may be a direction conversion section B formed between the first blades 153 and 163 and the second blades 155 and 165, the third section C may include second blade sections 155*b* and 165*b* formed in the second direction P2, and the fourth section D may include the first blade sections 155*a* and 165*a*.

The second section B may be a section where the first blades 153 and 163 are spaced apart from the second blades 155 and 165. The augers 150 and 160 may includes a plurality of blades of which waste toner transport directions are opposite to each other to include at least one direction conversion section.

Since the second section B, which is a direction conversion section, is provided in the middle part of the augers 150 and 160, the collected waste toner may be transported and accumulated based on the second section B. The waste toner flowing through the waste toner inlet 111 may be accumulated in the first section A, transported to the second section B by the first blades 153 and 163, and accumulated in the second section B by the second blades 155*b* and 165*b*. When the waste toner is accumulated up to the upper end of the waste toner container 110, the accumulated waste toner may spread out to the first section A and the third section C on the basis of the second section B.

Hereinafter, a process of dispersing waste toner will be described in detail.

Figure 5A:
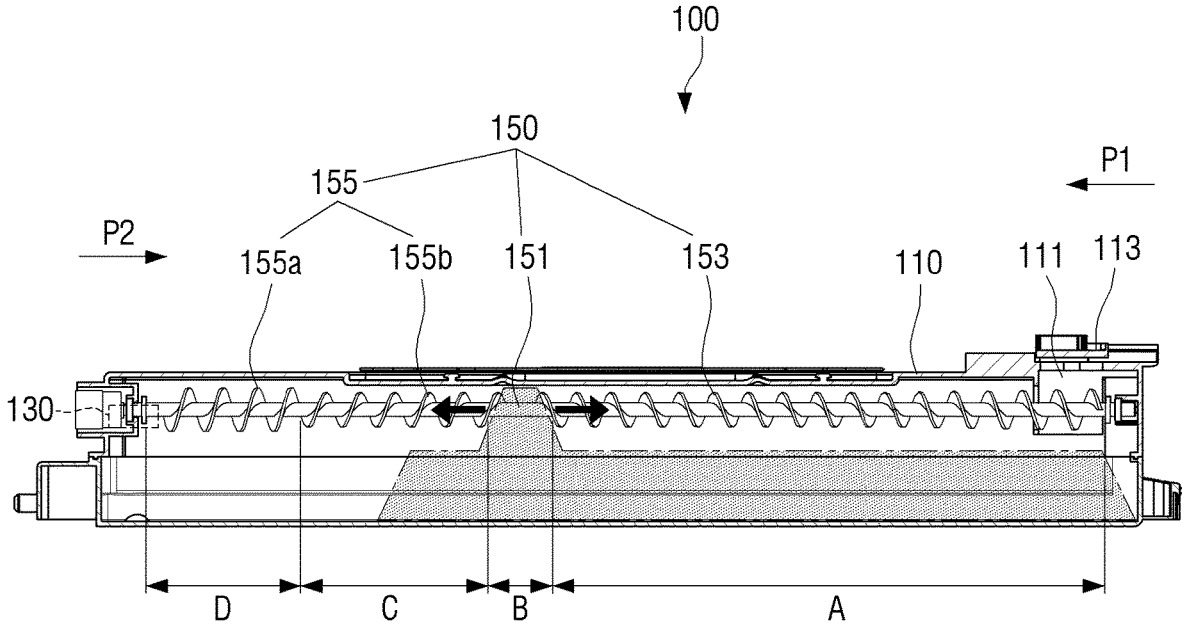
FIGS. 5A and 5B are cross-sectional views illustrating a process of dispersing waste toner collected and accumulated in a waste toner collecting device according to an example of the present disclosure.
Figure 5B:
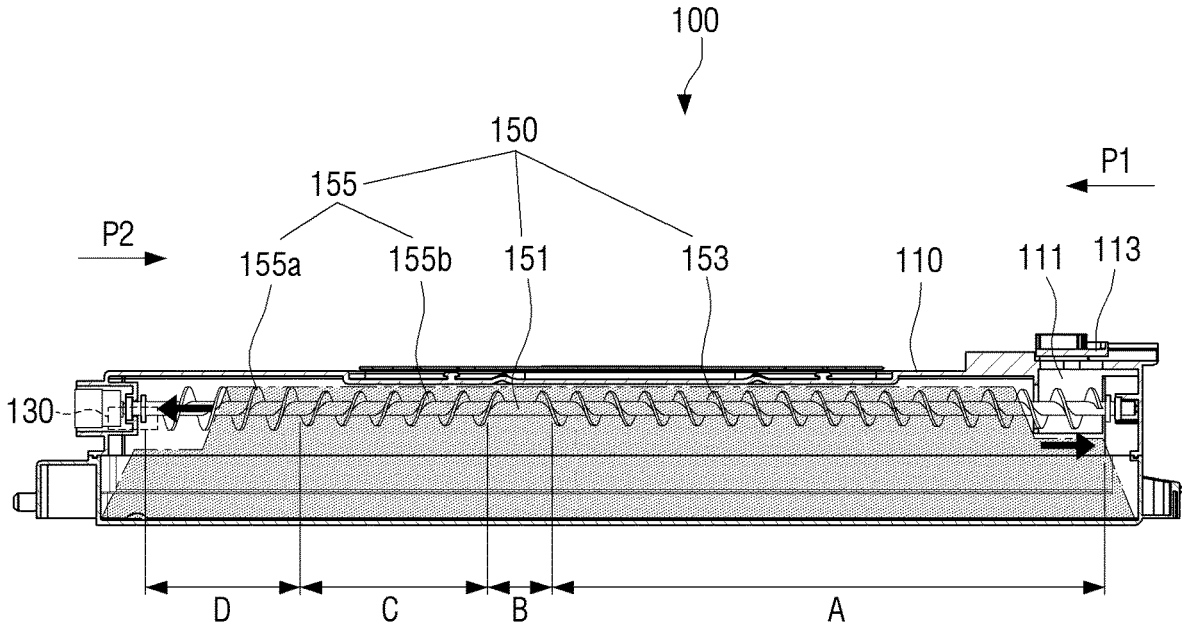

FIGS. 5A and 5B are cross-sectional views illustrating a process of dispersing waste toner collected and accumulated in a waste toner collecting device according to an example of the present disclosure. FIGS. 5A and 5B are time-series diagram illustrating a process of collecting waste toner in the waste toner collecting device 100.

Referring to FIG. 5A, waste toner flowing from the waste toner inlet 111 into the waste toner container 110 may drop by its own weight to be accumulated under the waste toner inlet 111. The waste toner may be accumulated in a mountain-like shape under the waste toner inlet 111, and the upper part of the waste toner in the mountain-like shape may be transported in the first direction P1 by the first blade 153 of the auger 150.

The waste toner transported from the first section A toward the first direction may be transported to the direction conversion section B by the second blade 155 which transports waste toner in the second direction P2 and accumulated in the direction conversion section B. When the waste toner accumulated in the direction conversion section B becomes equal to or more than a predetermined amount, and the waste toner accumulates up to the upper end of the waste toner container 110 in the direction conversion section B, the waste toner may push each other, spread out in the first direction P1 and the second direction P2 based on the direction conversion section B to be transported to the first section A and the third section C.

The waste toner may rise in a mountain-like shape by being pressed against each other when accumulated in the direction conversion section B, but there may be no blade in the direction conversion section B, so that toner may not be agglomerated in the auger 150. Accordingly, the torque rise of or damage to the auger 150 may be prevented.

Referring to FIG. 5B, the waste toner spreading out from the direction conversion section B toward the first direction P1, which is the first section A, may have a lower speed than the waste toner spreading out toward the second direction P2.

Since a waste toner transport rate of the fourth section D including the first blade section 155*a* is greater than waste toner transport rates of the first section A and the third section C, the amount of waste toner transported from the first blade section 155A, which is the fourth section D1, toward the second direction P2 may be increased. As the waste toner transport rate of the first blade section 155*a* increases, the speed of the waste toner transported toward the detector 130 may be reduced, so that a time for detecting waste toner by the detector 130 may be delayed.

Accordingly, the capacity of waste toner container 110 may be used at most, so that the waste toner collecting device 100 may be used longer.

Figure 6A:
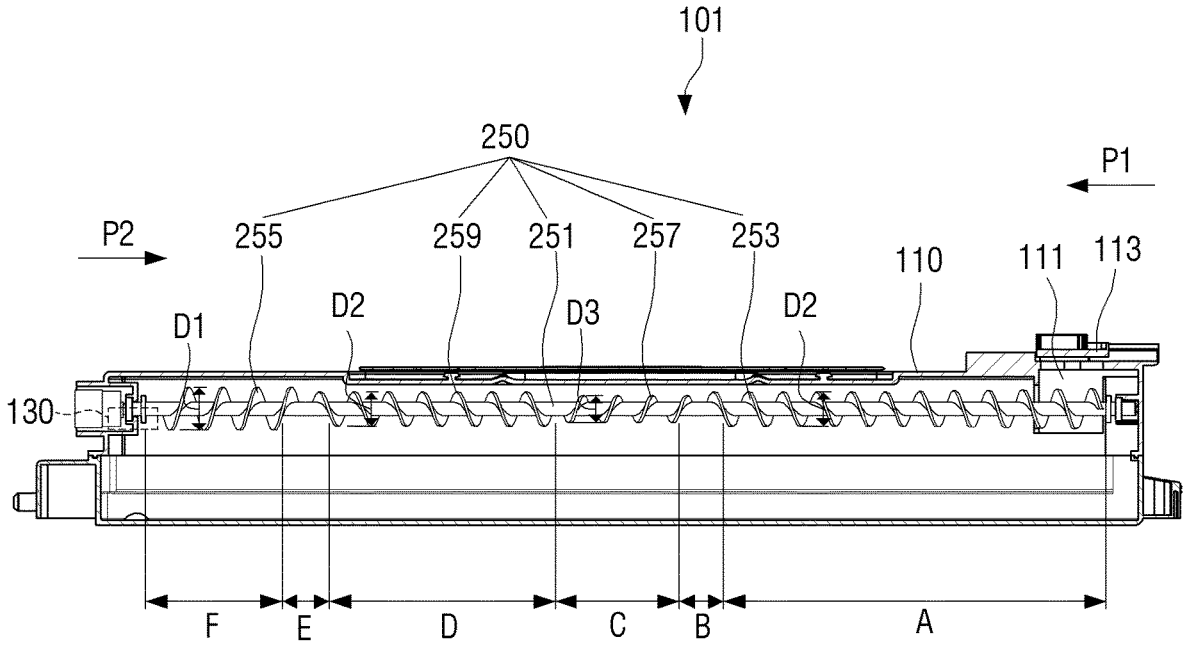
FIG. 6A is a cross-sectional view illustrating a waste toner collecting device according to another example of the present disclosure.
Figure 6B:
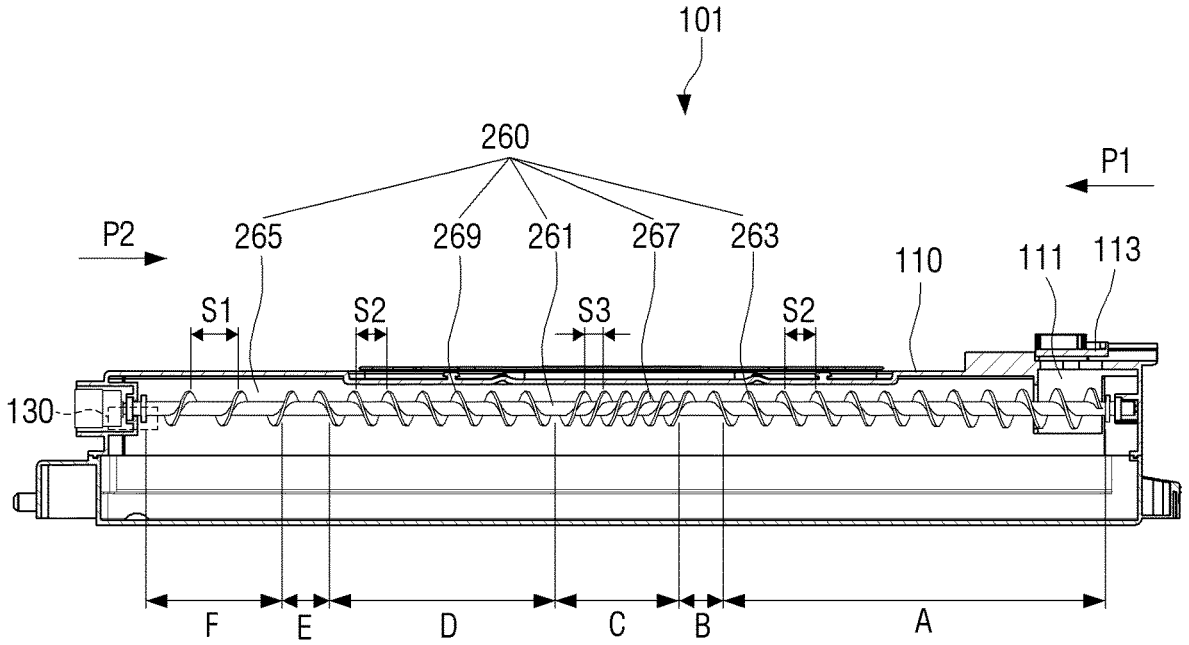
FIG. 6B is a cross-sectional view illustrating a waste toner collecting device to which an auger is applied according to another example of the present disclosure.

FIG. 6A is a cross-sectional view illustrating a waste toner collecting device according to another example of the present disclosure, and FIG. 6B is a cross-sectional view illustrating a waste toner collecting device to which an auger is applied according to another example of the present disclosure.

Referring to 6A, a waste toner collecting device 101 according to another example of the present disclosure may include a waste toner container 110, a detector 130, and an auger 250.

However, the waste toner container 110 and the detector 130 are same as those of the waste toner collecting device 100 according to an example of the present disclosure as shown in FIGS. 4A and 4B, the repeated description will be omitted. Hereinafter, the auger 250 according to another example of the present disclosure will be described for explaining difference.

The auger 250 may include a rotational shaft 251 and spiral-shaped blades 253, 255, 257, and 259. The rotational shaft 251 may be the same as the rotational shaft 151 described in FIGS. 4A and 4B, and thus the detailed description thereof will be omitted.

The blades 253, 255, 257 and 259 spirally protruding from the rotational shaft 251 may include a plurality of blades 253 and 259 which transport waste toner in the first direction P1 and a plurality of blades 255 and 257 which transport waste toner in the second direction P2.

The first direction P1 may be a direction from the waste toner inlet 111 toward the detector 130, and the second direction P2 may be a direction from the detector 30 toward the waste toner inlet 111, which is opposite to the first direction P1.

The auger 250 may include the blades 253 and 259 which transport waste toner in the first direction P1, and the blades 255 and 257 which transport waste toner in the second direction P2, which are alternately arranged on the rotational shaft 151.

At least one of the blades 253 and 259 which transport waste toner in the first direction P1 may be disposed adjacent to the waste toner inlet 111 on the rotational shaft 251. Since the blades 253 and 259 which transport waste toner in the first direction P1 are arranged adjacent to the waste toner inlet 111, the waste toner flowing into the waste toner inlet 111 and dropping may be transported in a length direction of the waste toner contained 110 to be dispersed.

At least one of the blades 255 and 257 which transport waste toner in the second direction P2 may be disposed adjacent to the detector 130 on the rotational shaft 251. Since the blades 255 and 257 that transport waste toner in the second direction P2 are disposed adjacent to the detector 130, a transport speed of the waste toner which is transported toward the detector 130 may be reduced, and thus the collecting space of the waste toner container 110 may be efficiently used.

The first, second, third and fourth blades 253, 255, 257 and 259 of the auger 250 may include the first blade 253 and the second blade 255, and the third blade 257 and the fourth blade 259 disposed between the first blade 253 and the second blade 255.

The third blade 257 and the fourth blade 259 disposed between the first blade 253 and the second blade 255 may be provided in plural, and the third and fourth blades may be alternately disposed in pairs on a rotational shaft.

The first blade 253 and the fourth blade 259 may transport waste toner flowing from the waste toner inlet 111 toward the first direction P1. The second blade 255 and the third blade 257 may transport waste toner flowing from the waste toner inlet 111 toward the second direction P2.

The first, second, third and fourth blades 253, 255, 257 and 259 may be disposed on the same rotational shaft 251. The first, second, third and fourth blades 253, 255, 257 and 259 may be sequentially disposed on the rotational shaft 251 in a direction from the waste toner inlet 111 toward the detector 130. When the rotational shaft 251 rotates, waste toner may be transported in the first direction P1 by the first blade 253 and the fourth blade 259, and transported in the second direction P2 by the second blade 255, and the third blade 257.

The first blade 253 may be disposed adjacent to the waste toner inlet 111, and the second blade 255 may be disposed adjacent to the detector 130. The first blade 253 may be disposed closer to the second direction P2 than the second blade 255 and transport waste toner flowing from the waste toner inlet 111 in a length direction of the waste toner container 110.

The second blade 255 may be a blade section having a waste toner transport rate greater than a waste toner transport rate of the first blade 253. The second blade 255 may be disposed closer to the first direction P1 than the first blade 253, and reversely transport the waste toner transported toward the detector 130 to thereby reduce a speed at which the waste toner is detected by the detector 130.

For example, when a diameter of the second blade 255 is greater than diameters of the first blade 253, the third blade 257, and the fourth blade 259, the amount of waste toner that remains near the second blade 255 may increase, so that the speed at which waste toner is transported toward the detector 130 may be reduced. Accordingly, it can be prevented that the waste toner container 110 is not filled, and the waste toner container 110 is replaced with a new one, so that the waste toner collecting device 101 may be used longer.

A transport speed of the waste toner transported to the detector 130 may be reduced by the second blade 255. Accordingly, a time for detecting whether the waste toner container is full by the detector 130 may be delayed.

FIG. 6A illustrates that the diameter D1 of the second blade 255 is greater than diameters of the other blades 253, 257 and 259, but the present disclosure is not limited thereto. The second blade 255 may be formed to have a waste toner transport rate greater than waste toner transport rates of other blade sections.

The first blade 253 to the fourth blade 259 may be arranged to be spaced apart from one another by a predetermined distance. For example, the auger 250 may include a plurality of sections. For example, the auger 250 may include 6 (six) sections. The first section A may include the first blade 253 formed in the first direction P1, the second section C may include the third blade 257 formed in the second direction P2, the third section D may include the fourth blade 259 formed in the first direction P1, and the fourth direction F may include the second blade 255 formed in the second direction P2.

The first direction conversion section B may be formed between the first section A and the second section C, and the second direction conversion section E may be formed between the third section D and the fourth section F.

The first direction conversion section B may be a section in which the first blade 253 and the third blade 257 are spaced apart from each other, and the second direction conversion section E may be a section in which the fourth blade 259 and the second blade 255 are spaced apart from each other.

When waste toner is centrally transported and collected based on the first and second direction conversion sections B and E, and the waste toner container 110 is filled up to its the upper end, the waste toner may press against each other and spread out toward the first direction P1 and the second direction P2 based on the first and second direction conversion sections B and E.

The auger 250 may have a plurality of direction conversion sections B and E. Accordingly, by reducing a length where the waste toner pushes against each other in both directions in the first and second direction conversion sections B and E, it is possible to prevent a torque of the auger 250 from being increased. Since a length where waste toner pushes against each other from a single direction conversion section toward the first and second directions P1 and P2 is smaller than a length where waste toner pushes against each other from a plurality of direction conversion sections B and E toward the first and second directions P1 and P2, the auger 250 may operate with a lower driving torque. As the driving torque of the auger 250 is reduced, a large amount of waste toner may be stacked, thereby maximizing the collecting capacity of the waste toner collecting device 101.

The diameter D1 of the second blade 255 disposed closest to the detector 130 may be greater than the diameter D2 of the fourth blade 259. The second blade 255 may increase the amount of waste toner transported in the second direction P2 and collect the waste toner in the waste toner container 110 as much as possible until when the waste toner is transported to the detector 130.

The diameter D2 of the first blade 253, the diameter D3 of the third blade 257, and the diameter D2 of the fourth blade 259 may be smaller than or the same as the diameter D1 of the second blade 255.

The diameter D3 of the third blade 257 which is disposed in the middle part of the auger 250 and transports the waste toner in the second direction P2 may be smaller than or the same as the diameter D2 of the first blade 253 and the fourth blade 259 which transports the waste toner in the first direction P1. Since the diameter D3 of the third blade 257 is smaller than the diameters of the first blade 253 and the fourth blade 259, waste toner may be smoothly transported in the central part of the auger 250, and thus the waste toner may be prevented from reversely flowing into the waste toner inlet 111.

The second blade 255 and the third blade 257 which transport waste toner in the second direction P2 may have the same length.

Referring to FIG. 6B, an auger 260 according to another example of the present disclosure may include a rotational shaft 261, and blades 263, 265, 267 and 269 for spirally winding the rotational shaft 261.

The first, second, third and fourth blades 263, 265, 267 and 269 which are different from the configurations of an example described in FIG. 6A will be described in detail.

For example, referring to FIG. 6B, a pitch S1 of the second blade 265 may be greater than pitches S2 and S3 of the first blade 263, the third blade 267, and the fourth blade 269. The pitch may refer to an arrangement spacing of blades in an axial direction of the rotational shaft 261. When the pitch of the second blade 165 is greater, the amount of waste toner transported from the second blade 165 toward the second direction P2 by rotation of the rotational shaft 261 may be greater than the amount of waste toner transported from other blade sections. The transport speed of the waste toner transported to the detector 130 may be reduced.

In addition, the pitch S3 of the third blade 267 which is provided in the middle of the auger 260 and transports waste toner in the second direction P2 may be smaller than or the same as the pitch S2 of the first blade 263 and the fourth blade 269 which transports waste toner in the first direction P1. Since the pitch S3 of the third blade 267 is smaller than the diameters of the first blade 263 and the fourth blade 269, waste toner may be smoothly transported in the central part of the auger 260, and thus waste toner may be prevented from reversely flowing into the waste toner inlet 111.

In other words, at least one of the diameter D1 or the pitch S1 of the second blade 265 may be greater than at least one of diameters or pitches of the third blade 267 and the fourth blade 259.

At least one of the diameter D3 or the pitch S3 of the third blade 267 may be smaller than at least one of diameters or pitches of the first blade 263, the second blade 265, and the fourth blade 269.

Figure 7A:
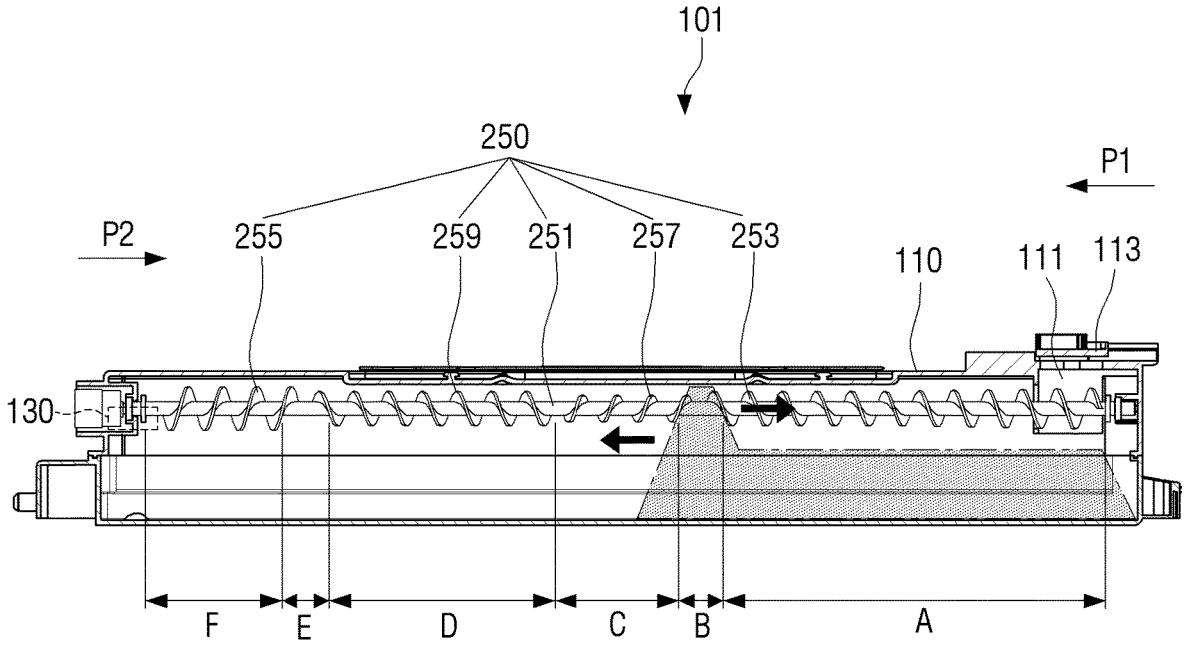
FIGS. 7A, 7B, and 7C are views illustrating a process of dispersing waste toner collected and accumulated in a waste toner collecting device according to another example of the present disclosure.
Figure 7B:
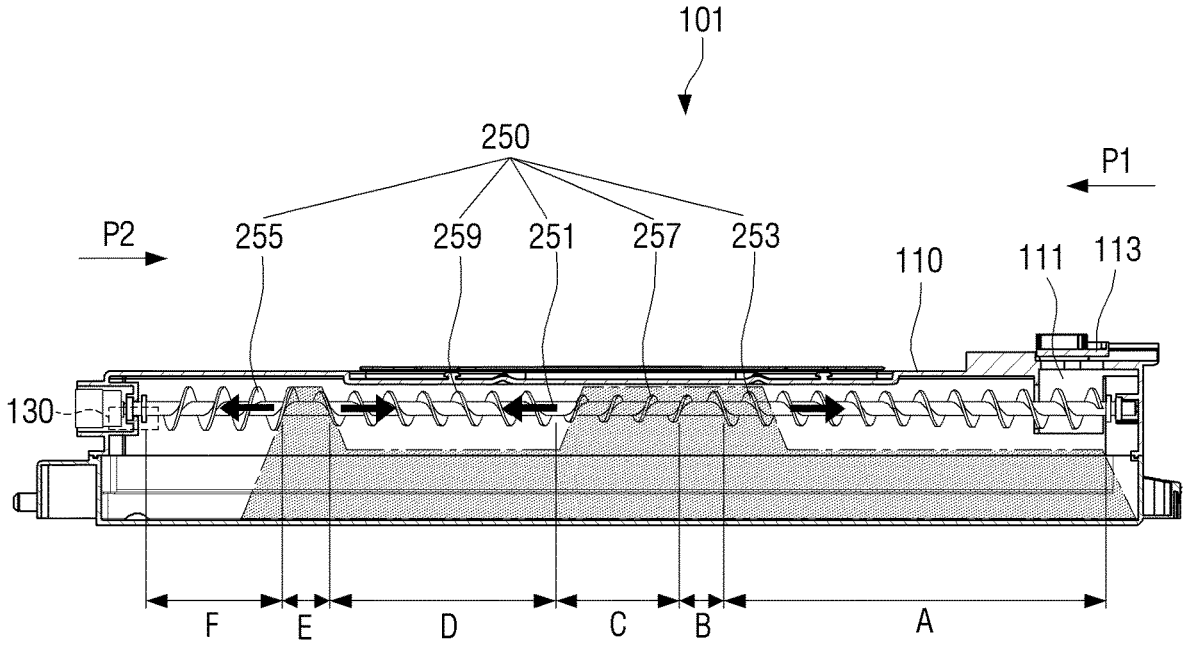
Figure 7C:
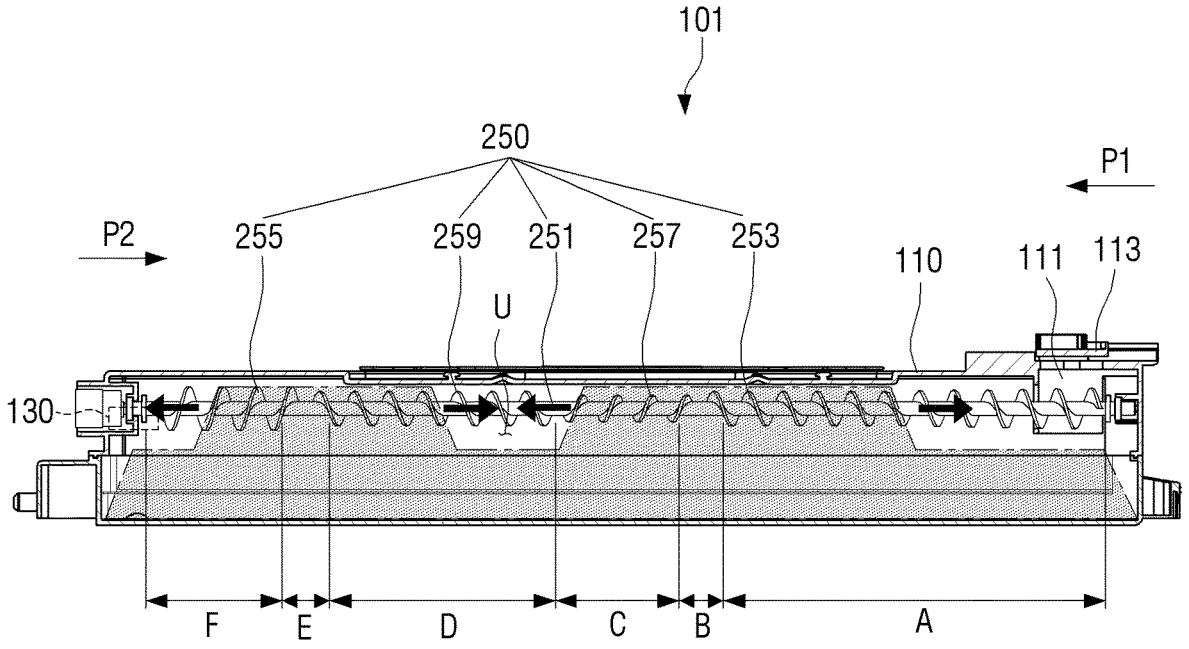

FIGS. 7A, 7B, and 7C are views illustrating a process of dispersing waste toner collected and accumulated in a waste toner collecting device according to another example of the present disclosure. FIGS. 7A, 7B, 7C illustrate a process of collecting waste toner in a waste toner collecting device according to an example of the present disclosure in a time series.

Referring to FIG. 7A, waste toner flowing from the waste toner inlet 111 into the waste toner container 110 may drop by its own weight and accumulate under the waste toner inlet 111. Waste toner may accumulate in a mountain-like shape under the waste toner inlet 111, and the upper part of the waste toner accumulated in a mountain-like shape may be transported in the first direction P1 by the first blade 253 of the auger 250.

The waste toner transported in the first direction P1 may be transported to the first direction conversion section B by the third blade 257 which transports waste toner in the second direction P2 and accumulated in the first direction conversion section B. When the waste toner accumulated in the first direction conversion section B accumulates in equal to or more than a predetermined amount, and the waste toner accumulates up to the upper end of the waste toner container 110 in the first direction conversion section B, the waste toner may push against each other and spread out toward the first direction P1 and the second direction P2 based on the first direction conversion section B.

The waste toner may rise in a mountain-like shape by being pressed against each other when accumulated in the first direction convention section B, but since there is no blade in the first direction conversion section B, the waste toner may not be agglomerated in the auger 250. Accordingly, the torque rise of or damage to the auger 250 may be prevented.

Referring to FIG. 7B, the waste toner transported from the first direction conversion section B toward the first direction P1 by the fourth blade 259 may be transported to the second direction conversion section E by the second blade 255 and accumulated in the second direction conversion section E. When the waste toner accumulated in the second direction conversion section E is in equal to or more than a predetermined amount, the waste toner may push against each other in the second direction conversion section E, and spread out toward the first direction P1 and the second direction P2 based on the second direction conversion section E.

A waste toner unit rate of the second blade 255 may be greater than a waste toner unit rate of the fourth blade 259, so that a speed of the waste toner transported from the second direction conversion section E toward the first direction P1 may be reduced.

When at least one of a diameter or a pitch of the second blade 255 is greater than at least one of diameters and pitches of other blades 253, 257 and 259, the amount of waste toner transported from the detector 130 toward the second direction P2 may be increased. As the second blade 255 increases the amount of waste toner transported in the second direction P2, a time for detecting waste toner by the detector 130 may be reduced. Accordingly, the space of the waste toner container 110 may be used as large as possible, so that the waste toner collecting device 101 may be used longer.

The waste toner may be evenly flattened over the entire area of the waste toner container 110 by the auger 250.

Referring to FIG. 7C, since the amount of waste toner transported from the second direction conversion section E toward the first direction P1 is smaller than the amount of waste toner transported from the second direction conversion section E toward the second direction P2, a time for detecting waste toner by the detector 130 may be delayed.

A space U where waste toner is filled the latest may be formed between the third blade 257 and the fourth blade 259 by the waste toner transported from the second direction conversion section E toward the second direction P2 and the waste toner transported from the first direction conversion section B toward the first direction P1.

A driving torque applied to the auger 250 may be reduced when the space U is formed. As the driving torque of the auger 250 is reduced, the large amount of waste toner may be stacked and the collecting capacity of the waste toner collecting device 101 may be maximized.

Although examples have been shown and described, it will be appreciated by those skilled in the art that changes may be made to these examples without departing from the spirit of the present disclosure. Accordingly, the scope of the present disclosure is not construed as being limited to the described examples, but is defined by the appended claims as well as equivalents thereto.

What is claimed is:

1. A waste toner collecting device, including:
a waste toner container to collect waste toner;
a detector to detect an amount of waste toner collected and accumulated in the waste toner container; and
an auger to disperse the waste toner in the waste toner container,
wherein the auger includes:
a first blade to transport the waste toner in a first direction toward the detector in the waste toner container; and
a second blade to transport the waste toner in a second direction away from the detector in the waste toner container,
wherein the second blade includes a first blade section having a waste toner transport rate greater than a waste toner transport rate of the first blade, and
wherein the first blade section is disposed closest to the detector among all blade sections of the second blade.

2. The waste toner collecting device as claimed in claim 1, wherein the auger further includes a rotational shaft to penetrate through the waste toner container,
wherein the first blade and the second blade are spiral-shaped blades disposed in a line to be spaced apart from each other by a predetermined distance on the rotational shaft,
wherein the first blade and the second blade are to wind the rotational shaft, and
wherein the second blade is disposed closer toward the detector than the first blade.

3. The waste toner collecting device as claimed in claim 2, wherein the auger further includes:
a third blade to transport the waste toner in the second direction; and
a fourth blade to transport the waste toner in the first direction,
wherein the third blade and the fourth blade are disposed between the first blade and the second blade.

4. The waste toner collecting device as claimed in claim 3, wherein an outer diameter of the third blade is less than or equal to an outer diameter of the first blade.

5. The waste toner collecting device as claimed in claim 3, wherein a length of the third blade is equal to a length of the second blade.

6. The waste toner collecting device as claimed in claim 3, wherein a pitch of the third blade is less than or equal to a pitch of the first blade.

7. The waste toner collecting device as claimed in claim 3, wherein an outer diameter of the fourth blade is equal to an outer diameter of the first blade.

8. The waste toner collecting device as claimed in claim 3, wherein the third blade and the fourth blade are disposed in plural, respectively, and
wherein the third blade and the fourth blade are alternately disposed in pairs on the rotational shaft.

9. The waste toner collecting device as claimed in claim 2, wherein the detector is disposed above a lowest point of the second blade in the waste toner container.

10. The waste toner collecting device as claimed in claim 1, wherein the first blade section of the second blade has an outer diameter greater than an outer diameter of the first blade and greater than an outer diameter of a second blade section of the second blade.

11. The waste toner collecting device as claimed in claim 1, wherein the first blade section of the second blade has a pitch greater than a pitch of the first blade and greater than a pitch of a second blade section of the second blade.

12. An image forming apparatus, including:
a printing engine;
a cleaning device to clean waste toner generated by the printing engine; and
a waste toner collecting device to collect the waste toner,
wherein the waste toner collecting device includes:
a waste toner container;
a detector to detect an amount of waste toner collected and accumulated in the waste toner container, the detector is disposed on a side of the waste container opposite to a waste toner inlet; and
an auger to disperse the waste toner in the waste toner container and adjust a waste toner collecting speed of waste toner transported toward the detector, the auger comprising:
a rotational shaft to penetrate through the waste toner container; and
a plurality of blades extending spirally along the rotational shaft,
wherein the plurality of blades include a first blade to transport the waste toner in a first direction toward the detector, and a second blade disposed to face the first blade and to transport the waste toner in a second direction opposite to the first direction, wherein the second blade is disposed closer to the detector than the first blade, wherein the second blade includes a first blade section having a waste toner transport rate greater than a waste toner transport rate of the first blade, and wherein the first blade section is disposed closest to the detector among all blade sections of the second blade.

13. The image forming apparatus as claimed in claim 12, wherein the first blade and the second blade are alternately disposed in pairs on the rotational shaft.

14. The image forming apparatus as claimed in claim 13, wherein an outer diameter of the first blade section of the second blade is greater than an outer diameter of the first blade and is greater than an outer diameter of a second blade section of the second blade.

15. The image forming apparatus as claimed in claim 12, wherein the first blade section of the second blade is contiguous to a second blade section of the second blade.

* * * * *